United States Patent [19]

Minter

[11] Patent Number: 4,716,683

[45] Date of Patent: Jan. 5, 1988

[54] DOOR WEATHERSTRIPPING ASSEMBLY

[75] Inventor: Mearl J. Minter, Oskaloosa, Iowa

[73] Assignee: Rolscreen Company, Pella, Iowa

[21] Appl. No.: 732,949

[22] Filed: May 13, 1985

[51] Int. Cl.[4] ..... E06B 7/16

[52] U.S. Cl. ..... 49/479; 49/488; 49/489; 49/495

[58] Field of Search ..... 49/488, 489, 495, 484, 49/485, 470, 380, 476, 479, 498

[56] References Cited

U.S. PATENT DOCUMENTS

| | | | |
|---|---|---|---|
| Re. 25,590 | 6/1964 | Miller | 49/468 |
| 1,967,456 | 7/1934 | Swedman et al. | 49/498 |
| 2,700,197 | 1/1955 | Kesling | 49/479 |
| 2,976,584 | 3/1961 | Ghormley | 49/470 |
| 3,114,946 | 12/1963 | Fluck | 49/470 |
| 3,140,517 | 7/1964 | Richter | 49/489 |
| 3,142,097 | 7/1964 | Oehmig | 49/476 |
| 3,273,287 | 9/1966 | Pease, Jr. | 49/468 |
| 3,284,976 | 11/1966 | Kadish | 52/455 |
| 3,374,580 | 3/1968 | Ruff | 49/482 |
| 3,378,958 | 4/1968 | Parks | 49/489 |
| 3,432,966 | 3/1969 | Bordner | 49/368 |
| 3,448,543 | 6/1969 | Multer | 49/470 |
| 3,453,780 | 7/1969 | Thompson | 49/482 |
| 3,462,899 | 8/1969 | Sherman | 52/309.6 |
| 3,501,866 | 3/1970 | Johnson | 49/380 |
| 3,504,456 | 4/1970 | Frederick, Jr. | 49/470 |
| 3,604,152 | 9/1971 | Protzman | 49/470 |
| 3,750,333 | 8/1973 | Vance | 49/501 |
| 3,762,100 | 10/1973 | Kempel | 49/468 |
| 3,796,006 | 3/1974 | Dixon | 49/493 |
| 3,837,134 | 9/1974 | DiFazio | 52/804 |
| 3,854,246 | 12/1974 | McAllister | 49/470 |
| 3,900,967 | 8/1975 | Bursk et al. | 49/468 |
| 3,958,369 | 5/1976 | Mathellier | 428/407 |
| 3,962,828 | 6/1976 | McAllister | 49/468 |
| 4,006,562 | 2/1977 | Belanger et al. | 49/380 |
| 4,010,573 | 3/1977 | Andrzejewski | 49/479 |
| 4,034,511 | 7/1977 | Bursk | 49/488 |
| 4,055,917 | 11/1977 | Coller | 49/469 |
| 4,122,632 | 10/1978 | Dixon | 49/470 |
| 4,192,101 | 3/1980 | White | 49/478 |
| 4,255,902 | 3/1981 | Ruff | 49/488 |
| 4,300,314 | 11/1981 | Dittrich | 49/470 |
| 4,310,991 | 1/1982 | Seely | 49/470 |
| 4,386,482 | 6/1983 | Quinif | 49/488 |
| 4,441,278 | 4/1984 | Covey, III | 49/477 |
| 4,513,536 | 4/1985 | Giguere | 49/470 |

FOREIGN PATENT DOCUMENTS

| | | | |
|---|---|---|---|
| 1048101 | 6/1963 | United Kingdom | 244/99 |

OTHER PUBLICATIONS

Sager Building Products, 16 Dec. 1963, Flyer.
Jarrow Products, 21 May 1952, Flyer.
Acurn Building Components, Inc., Series A-220, Steel Insul. Door Pemko Interlocking Weatherstrip.

*Primary Examiner*—Kenneth J. Dorner
*Assistant Examiner*—Gerald A. Anderson
*Attorney, Agent, or Firm*—Zarley, McKee, Thomte, Voorhees & Sease

[57] ABSTRACT

An improved door weatherstripping assembly includes a first compressible weatherstripping member mounted on and extending continuously around a door with a compressible bulbous body for compressive sealing engagement between the door and the stop member of the door frame upon closure of the door within the frame. A second flexible weatherstripping member is mounted on and extends around the door forwardly of the first weatherstripping member for providing a rain screen effect upon closure of the door within the frame. The second weatherstripping member includes a flexible leaf element for frictionally engaging the stop member of the frame upon closure of the door within the frame.

3 Claims, 9 Drawing Figures

DOOR WEATHERSTRIPPING ASSEMBLY

BACKGROUND OF THE INVENTION

Three types of weatherstripping are commonly used on doors. A leaf type assembly uses a plastic or metallic flexible leaf that attaches to the door frame and folds against the door when the door is closed within the frame. A magnetic type weatherstripping utilizes a magnetic weatherstripping element on portions of the door frame in conjunction with a steel door which seals upon closing within the frame. The compression type weatherstripping employs either a plastic bulbs or foam extrusions which are generally attached to the door frame and compressed between the frame and the door upon closing of the door within the frame.

These three types of weatherstripping assemblies are all mounted on the door frame. Such mounting places the header, lock jamb and hinge jamb weatherstripping on a different plane than the sill weatherstripping and thus the lower corners of the doors are difficult to seal. Also, separate pieces of weatherstripping are usually used on the header, lock jamb and hinge jamb of the door frame, rather than extending continuously around the frame, such that the upper door corners are difficult to seal.

Therefore, a primary objective of the present invention is the provision of an improved door weatherstripping assembly.

A further objective of the present invention is the provision of a door weather stripping assembly which utilizes a dual layer of weatherstripping.

Another objective of the present invention is the provision of a door weatherstripping assembly which more completely seals the door against both air and moisture leakage.

Still another objective of the present invention is the provision of a door weatherstripping assembly which eliminates the need for any adjustment of the frame as a result of relative movement between the door and door frame. As an example, uneven settling of the door sill will not require adjustment of the door sill or the weatherstripping.

A further objective of the present invention is the provision of an improved door weatherstripping assembly which is economical to manufacture and durable in use.

SUMMARY OF THE INVENTION

The door weatherstripping assembly of the present invention generally comprises a door hingedly mounted within a door frame for closing toward a stop member on the door frame. The door has front and back surfaces and a primary peripheral edge. A first compressible weatherstripping member is mounted on and extends continuously around the door for compressive sealing engagement between the door and the frame stop member upon closure of the door within the frame. A second flexible weatherstripping member is also mounted on the door forwardly of the first weatherstripping member for providing a rain screen effect upon closure of the door within the frame.

More particularly, the door has a perimeter notch in the primary peripheral edge extending to the front surface of the door so as to define a second peripheral edge adjacent the front surface of the door and a door stop surface between the primary and secondary peripheral edges. The first weatherstripping member includes a hollow bulbous body with an integrally formed flange frictionally fit within a slot in the secondary peripheral edge such that the bulbous body is adjacent the door stop surface. The flange is notched adjacent the door corners to permit the bulbous body to extend continuously around the corners and a resilient plug is fit within the bulbous body at each corner to maintain the shape of the bulbous body.

The second weatherstripping member includes separate first, second, third and fourth sections extending along the top portion, each side portion, and the bottom portion of the door, respectively. At least the first three sections of the second weatherstripping member include a flexible leaf element extending radially outward from the secondary peripheral edge of the door to frictionally engage the respective door frame stop member upon closure of the door within the frame. The fourth section of the second weatherstripping member includes an extruded element mounted on the second peripheral edge of the door and having a lip extending forwardly of the front surface of the door. The lip is angled downwardly with respect to the front surface such that water running down the front surface of the door is directed away from the door and the first weatherstripping member. A flexible leaf extends downwardly from the lip toward the sill to provide a rain screen effect at the lower portion of the door.

An L-shaped element having elongated bristles is positioned between the first weatherstripping member and the four sections of the second weatherstripping member at the corners of the door to prevent moisture from reaching the first weatherstripping member.

DETAILED DESCRIPTION OF THE PREFERRED EMBODIMENT

Figure 2:
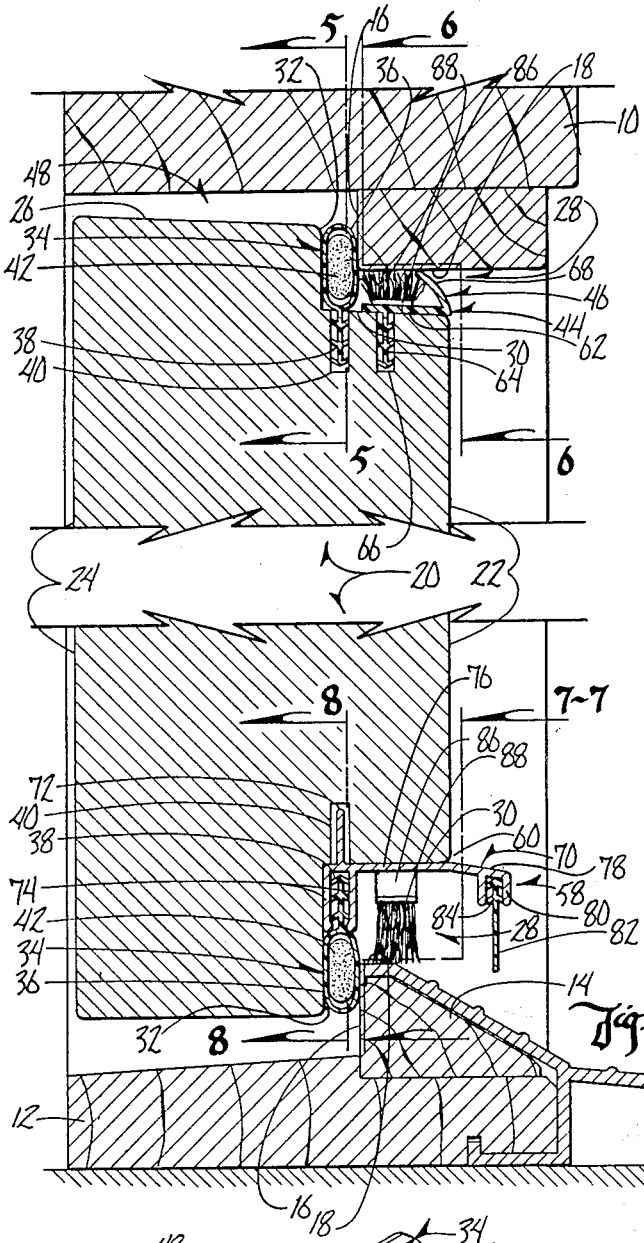
FIG. 2 is a partial sectional view taken along lines 2—2 of FIG. 1.
Figure 1:
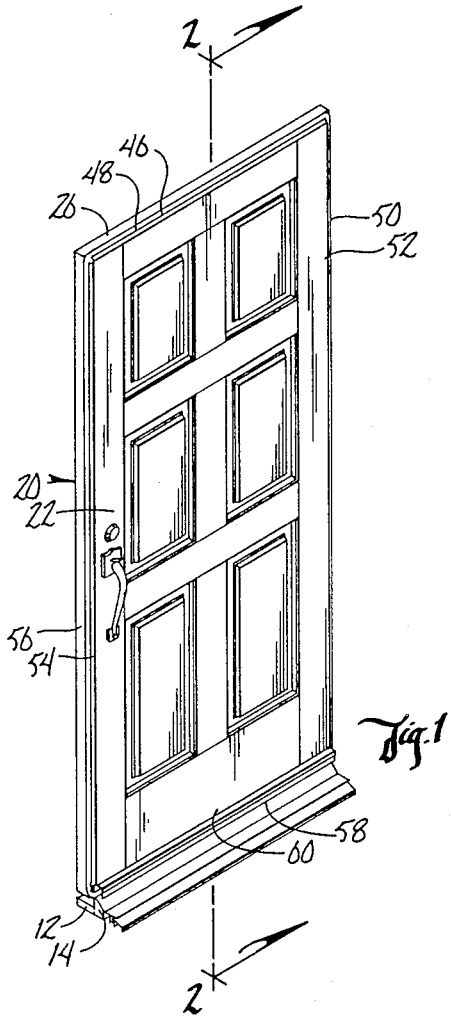
FIG. 1 is a perspective view of the door weatherstripping assembly of the present invention.
Figure 3:
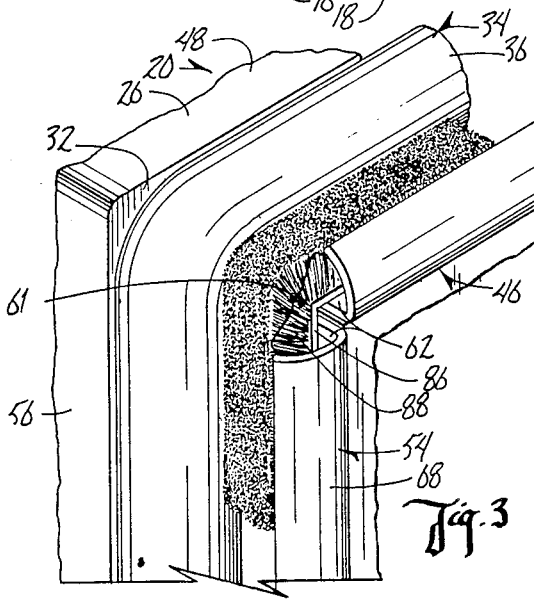
FIG. 3 is an enlarged partial perspective view of an upper corner of the door.

The improved door weatherstripping assembly of the present invention is for use in a door frame which generally includes a header 10, opposite side jambs (not shown), and a sill or threshold 12. A stop member 14 having a vertical stop surface 16 and an entry surface 18 is attached to and extends around the interior perimeter of the door frame.

A door 20 is hingedly mounted on one side jamb of the door frame for closing toward stop member 14. Door 20 has a front surface 22, a back surface 24, and a primary peripheral edge 26. Door 20 also has a notch 28 in primary peripheral edge 26 which extends to front surface 22 of door 20 so as to define a second peripheral edge 30 adjacent front surface 22 and a vertical door stop surface 32 extending between primary periperal edge 26 and secondary peripheral edge 30.

Figure 4:
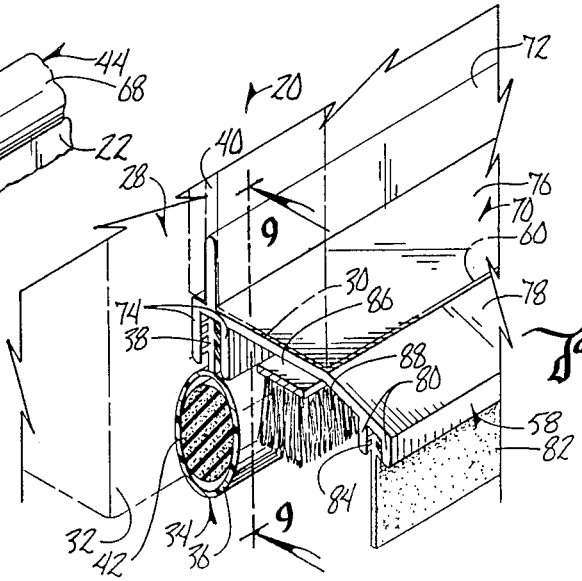
FIG. 4 is an enlarged partial perspective view of the lower corner of the door.
Figures 5, 6, 7, 8, 9:
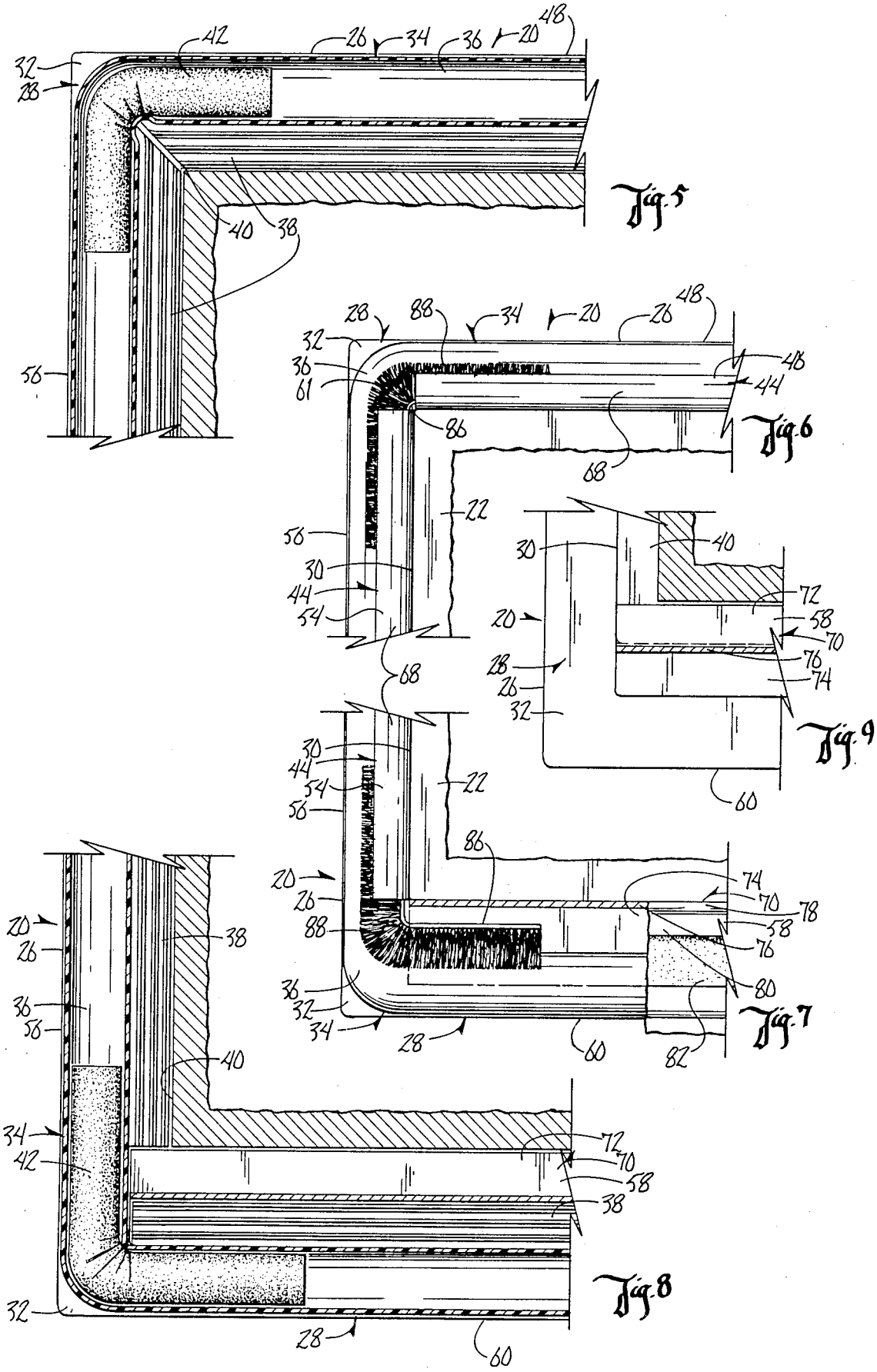
FIG. 5 is a partial sectional view taken along lines 5—5 of FIG. 2.
FIG. 6 is a view taken along line 6—6 of FIG. 2 showing an upper corner of the door with the door in an open position.
FIG. 7 is a view taken along line 7—7 of FIG. 2 showing a lower corner of the door.
FIG. 8 is a partial sectional view taken along lines 8—8 of FIG. 2.
FIG. 9 is a view taken along lines 9—9 of FIG. 4 showing the lower corner of the door with the aluminum extrusion fit within the lower door slot.

A first weatherstripping member 34 is mounted on and extends continuously around door 20 for compressive sealing engagement between the door and stop member 14 upon closure of the door within the door frame. More particularly, first weatherstripping member 34 includes a hollow bulbous body 36 with a barbed flange 38 integrally formed therewith. Bulbous body 36 is substantially elliptical in cross section, so as to have a major axis and a minor axis, as seen in FIGS. 2 and 4. Barbed flange 38 frictionally fits within a slot 40 formed within secondary peripheral edge 30 as to as secure first weatherstripping member 34 to door 20 an such that bulbous body 36 is adjacent door stop surface 32. Flange 38 is notched at the corners of door 20 such that bulbous body 36 extends continuously around the door corners, as best seen in FIGS. 5 and 8. A resilient plug 42 is placed within hollow bulbous body 36 at each corner of door 20 for maintaining the shape of bulbous body 36 at each corner of the door. Adhesive material may be used within slot 40 to further secure first weatherstripping member 34 to door 20.

Thus, bulbous body 36 is compressed between stop surface 32 of door 20 and vertical stop surface 16 of stop member 14 to provide an airtight seal when door 20 is closed within the door frame. Also, since first weatherstripping member 34 engages the vertical stop surface 16 of stop member 14 at the bottom of the door frame, as well as the top and sides of the door frame, rather than the entry surface 18 of stop member 14, the compressive seal between door 20 and the door frame will be maintained even if some relative movement occurs between the door and the frame. For example, such movement may include settling of the threshhold or the door with respect to one another and may be as much as plus or minus ⅜ inch. Thus, since first weatherstripping member 34 accommodates such relative movement, the need for an adjustable door sill is eliminated.

A second flexible weatherstripping member 44 is mounted on and extends around door 20 forwardly of first weatherstripping member 34 for providing a rain screen effect upon closure of door 20 within the door frame. More particularly, second weatherstripping member 44 includes a first section 46 extending along the top portion 48 of door 20, a second section 50 extending along the hinge side 52 of door 20, a third section 54 extending along the lock side 56 of door 20, and a fourth section 58 extending along the bottom portion 60 of door 20. Each section 46, 50, 54, and 58 is separate from the adjacent sections and extends along the length of the respective door portion. A gap 61 is present at each corner of door 20 between the ends of adjacent sections.

At least the first three sections 46, 50 and 54 are identical to one another, and include a base portion 62, an integrally formed barbed flange 64 extending from base portion 62 and frictionally fit within a second slot 66 in secondary peripheral edge 30 of door 20 for securing the respective weatherstripping section to the door, and an integrally formed flexible leaf element 68 extending radially outwardly from secondary peripheral edge 30 to frictionally engage the respective entry surface 18 of stop member 14 upon closure of door 20 within the door frame. Adhesive may be used within slot 66 to further secure the sections of second weatherstripping member 44 to door 20.

While fourth section 58 may be identical to the first three sections of second weatherstripping member 44, preferably fourth section 58 includes an extruded element 70, best seen in FIG. 4. Extruded element 70 includes an upwardly extending flange 72 for securing the element within slot 40 of secondary peripheral edge 30 and a pair of downwardly extending flanges 74 for receiving barbed flange 38 of first weatherstripping member 34 along the bottom portion 60 of door 20. Flange 72 may be frictionally fit or glued within slot 40 for securing extruded element 70 to door 20.

Extruded element 70 further includes a forwardly extending portion 76 matingly engaging secondary peripheral edge 30 of door 20. Portion 76 terminates in a downwardly angled lip 78 extending forwardly of front surface 22 of door 20, with a pair of flanges 80 extending downwardly from the edge of lip 78. Lip 78 directs water running down the front surface 22 of door 20 away from the door. A flexible leaf 82 having a barbed upper edge 84 is frictionally fit between flanges 80 and extends downwardly towards sill 12. Leaf 82 is long enough to brush across the top of sill 12 when door 20 is closed within the door frame. Leaf 82 prevents rain or water from being blown toward first weatherstripping member 34.

Second weatherstripping member 44 also includes an L-shaped element 86 having elongated bristles 88 made of mohair or the like, which is positioned between first weatherstripping member 34 and leaf elements 68 and 82 of the four sections of second weatherstripping member 44 at the corners of the door so as to bridge gap 61 between the ends of the adjacent sections. Bristles 88 of L-shaped element 86 prevent moisture from reaching first weatherstripping member 34 at the corners of door 20. L-shaped element 86 is glued, stapled or tacked in place.

In the drawings, L-shaped element 86 is shown to be attached to the base portion 62 of first section 46 and third section 54 at one upper corner of the door. A similar arrangement is provided at the other upper corner of the door. Bristles 88 extend outwardly beyond leaf element 66 of second weatherstripping member 44 when the door is open, as seen in FIG. 6 and brush against entry surface 18 of stop member 14 when door 20 is closed within the door frame, as seen in FIG. 2. At the bottom corners of the door, the portion of L-shaped element 86 extending along the bottom portion 60 of door 20 is spaced apart from extruded element 70 such that bristles 88 brush across the top of sill 12 when door 20 is closed within the door frame, as seen in FIGS. 2, 4 and 7. A spacer element (not shown) may be provided to fill the gap between L-shaped element 86 and forwardly extending portion 76 of extruded element 70.

Referring to FIG. 5, at the upper corners of the door, the notch in barbed flange 38 of first weatherstripping member 34 is preferably V-shaped before first weatherstripping member 34 is folded around the corner of door 20. Such a V-shaped notch permits the portions of flange 38 on either side of the notch to extend substantially to the corner of the door for support of the adjacent bulbous body 36. In comparison, at the bottom corners of the door as shown in FIG. 8, the notch in barbed flange 38 is elongated or U-shaped so as to permit flange 72 of extruded element 70 to extend along the length of slot 40 in bottom portion 60 of door 20.

Thus, first weatherstripping member 34 provides a continuous airtight seal around the perimeter of door 20 while second weatherstripping member 44 provides a substantially continuous windscreen about the perimeter of the door. Also, at least along bottom portion 60 of door 20, the pressure on each side of leaf 82 of fourth section 58 of second weatherstripping member 44 is equal to further prevent water an air from being drawn rearwardly beyond the weatherstripping members. The door weatherstripping assembly of the present invention therefore accomplishes at least all of the state objectives.

What is claimed is:

1. An improved door weatherstripping assembly for use in a door frame including a header, opposite side jams, a sill and a door stop member extending around the interior perimeter of said door frame, said door stop member having a vertical stop surface an an entry surface disposed perpendicularly to said stop surface, said assembly comprising:

a door hingedly mounted on one side of said side jambs for closing toward said stop member and having a vertical front surface, a back surface and a primary peripheral edge extending between said front and back surfaces, and a first compressible weatherstripping member mounted on and extending continuously around said door for compressive sealing engagement between said vertical front surface of said door and said vertical stop surface of said stop member upon closure of said door within said frame so as to provide a substantially air-tight seal therebetween;

a second flexible weatherstripping member mounted on and extending around said door forwardly of said first weatherstripping member for providing a rain screen effect upon closure of said door within said frame;

said second weatherstripping member including separate first, second, third and fourth elongated sections extending along the length of the top portion, one side portion, the other side portion, and the bottom portion of said door, respectively;

at least said first, second and third sections of said second weatherstripping member each including a flexible leaf element for frictionally engaging said respective entry surfaces and said stop member upon closure of said door within said frame and thereby provide a substantially water-tight seal between said stop member and said door;

said fourth section of said second weatherstripping member further including an extruded element mounted on said door and having a lip extending forwardly of said front surface of said door, said lip being angled downwardly with respect to said front surface of said door such that water running down said front surface is directed away from said door and said first weatherstripping member by said lip;

said door having a perimeter notch in said primary peripheral edge extending to said front surface of said door so as to form a secondary peripheral edge adjacent said front surface of said door and a vertical stop surface extending between said primary and secondary peripheral edges, said first weatherstripping member being positioned adjacent said vertical stop surface of said door;

said first second and third sections of said second weatherstripping member each including a base portion integrally formed with said leaf element and engaging said secondary peripheral edge of said door and an integrally formed flange extending from said base portion and operatively fitting into a second slot in said secondary peripheral edge for securing the respective section to said door.

2. An improved door weatherstripping assembly for use in a door frame including a header, opposite side jambs, a sill and a door stop member extending around the interior perimeter of said door frame, said door stop member having a vertical stop surface and an entry surface disposed perpendicularly to said stop surface, said assembly comprising:

a door hingedly mounted on one side of said side jambs for closing toward said stop member and having a vertical front surface, a back surface and a primary peripheral edge extending between said front and back surfaces, and a first compressible weatherstripping member mounted on and extending continuously around said door for compressive sealing engagement between said vertical front surface of said door and said vertical stop surface of said stop member upon closure of said door within said frame so as to provide a substantially air-tight seal therebetween;

a second flexible weatherstripping member mounted on and extending around said door forwardly of said first weatherstripping member for providing a rain screen effect upon closure of said door within said frame;

said second weatherstripping member including separate first, second, third and fourth elongated sections extending along the length of the top portion, one side portion, the other side portion, and the bottom portion of said door, respectively;

at least said first, second and third sections of said second weatherstripping member each including a flexible leaf element for frictionally engaging said respective entry surfaces of said stop member upon closure of said door within said frame and thereby provide a substantially water-tight seal between said stop member and said door;

a gap exists at each corner of said door between the ends of adjacent sections of said second weatherstripping member and said second weatherstripping member further including an L-shaped element having elongated bristles positioned between said first weatherstripping member and said sections of said second weatherstripping member at the corners of said door so that said bristles extend around the corners of the door and thereby bridge said gap existing between the ends of adjacent sections.

3. An improved door weatherstripping assembly for use in a door frame including a header, opposite side jambs, a sill and a door stop member extending around the interior perimeter of said door frame, said door stop member having a vertical stop surface and an entry surface disposed perpendicularly to said stop surface, said assembly comprising:

a door hingedly mounted on one side of said side jambs for closing toward said stop member and having a vertical front surface, a back surface and a primary peripheral edge extending between said front and back surfaces, and said door having a perimeter notch in said primary peripheral edge extending to said front surface of said door so as pg,17 to form a secondary peripheral edge adjacent said front surface of said door and a vertical stop surface extending between said primary and secondary peripheral edges;

a first compressible weatherstripping member mounted in said notch adjacent said vertical stop surface of said door and extending continuously around said door for compressive sealing engagement between said vertical stop surface of said door and said vertical stop surface of said stop member upon closure of said door within said frame so as to provide a substantially air-tight seal therebetween; and a second flexible weatherstripping member mounted in said notch and extending around said door forwardly of said first weatherstripping member for frictionally engaging the entry surface of said door stop member along at least the top and side edges of said door to provide a substantially water-tight seal therebetween;

said second weatherstripping member including separate first, second, third and fourth elongated sections extending along the length of the top portion, one side portion, the other side portion, and bottom portion of said door, respectively, with a gap existing between the ends of adjacent sections at each corner of the door, and further including an L-shaped element having elongated bristles positioned between said first weatherstripping member and said sections of said second weatherstripping member at the corners of said door so that the bristles extend around the corners of said door and thereby bridge the gap between the ends of adjacent sections of said second weatherstripping member.

* * * * *